United States Patent [19]

Smith

[11] Patent Number: 4,681,358

[45] Date of Patent: Jul. 21, 1987

[54] CONTAINER OPENING TECHNOLOGY

[76] Inventor: Thomas T. Smith, 1731 10th St., S., Fargo, N. Dak. 58103

[21] Appl. No.: 202,672

[22] Filed: Oct. 31, 1980

[51] Int. Cl.[4] ..... B67B 7/44

[52] U.S. Cl. ..... 294/15; 294/1.1; 81/3.55

[58] Field of Search ..... 294/15, 26, 99, 103 R; 81/3.41, 3.46 R, 3.46 A, 3.47, 3.1 R, 3.38 A, 3.34, 3.37, 3.36; 215/304; 220/270, 274

[56] References Cited

U.S. PATENT DOCUMENTS

| | | | |
|---|---|---|---|
| 2,856,804 | 10/1958 | Whiteley | 81/3.46 |
| 3,379,334 | 4/1968 | Young | 220/54 |
| 3,460,411 | 8/1969 | Dyer | 81/3.34 |
| 3,656,375 | 4/1972 | Reed | 81/3.46 |
| 3,730,025 | 5/1973 | Monnerjahn | 81/3.4 |
| 3,751,743 | 8/1973 | Buck | 7/14.6 |
| 3,812,741 | 5/1974 | Heine | 81/3.4 |
| 4,120,216 | 10/1978 | Goldberg | 81/3.46 |
| 4,133,228 | 1/1979 | DePooter | 81/3.46 A |
| 4,207,781 | 6/1980 | Greenwood | 81/3.46 |
| 4,309,921 | 1/1982 | Miller | 81/3.46 R |

*Primary Examiner*—James B. Marbert
*Attorney, Agent, or Firm*—Anthony G. Eggink

[57] ABSTRACT

The opening device is for aiding the opening of containers having either the non-detachable, component type opening system or the twist-off type cap. The former system being characterized as having a scored section at the top of the container with an empaling tab in fulcrum alignment attached thereto. The opening device includes a unitary body member which has a leading end portion for sliding beneath the empaling tab and a trailing handle portion for grasping by the user, and tab restraining means for engaging the top of the empaling tab as the leading end portion is placed beneath the tab. The tab restraining means project upward from the side edges of the body member and then projects spacially parallel to at least a portion of the upper surface of the body member. After placement of the device with the leading end portion beneath and the tab restraining means above the empaling tab the user grasps the handle portion and lifts it upward and in a forward direction, thereby, easily separating and pushing downward the scored section of the opening system. Thus, access is gained to the container by the leveraged, mechanical advantage of the opening device. At the trailing handle portion of the body member a generally circular aperture aids, in a similar manner, the removal of twist-off caps. The interior periphery of the aperture can either be supplied with inwardly projecting members or with a beveled resilient insert to securedly engage the grooved outward periphery of the twist-off cap to be removed.

11 Claims, 9 Drawing Figures

CONTAINER OPENING TECHNOLOGY

This invention relates to an opening device for containers designed to be openable by the average consumer without the aid of mechanical apparatus. Particularly, this invention relates to a device to aid a consumer in the opening of containers having either the non-detachable, component type opening system or the twist-off type cap.

Containers having opening systems that do not require the use of mechanical apparatus have become increasingly popular. The twist-off bottle cap used primarily in the beverage industry is one example, and the non-detachable, component type used in the beverage and can industry is another. The non-detachable component opening system, particularly, has gained and continues to gain widespread use for ecological reasons, and continues to replace the removable, throw-away ring type opening tab system popularly used in the beverage industry.

The non-detachable component system is generally characterized by a scored or weakened section in the container top having an empaling tab attached or riveted thereto in fulcrum alignment with that scored section. A user of a container having an opening system of this type grasps the rear portion of the empaling tab, lifts it in an upward and forward direction and, thereby, causes the frontal portion of the tab to tear and push downward the scored section beneath it, and, thus, allows the user to gain access to the contents of the container.

Although the openability of many of these easy opening systems have been adequate to the average consumer, unfortunately, they have presented an undue burden to a multitude of consumers. The non-detachable, component opening system, particularly, has resulted in many broken finger nails, lacerated finger tips and other bodily injuries. This difficulty has been the result of the manufacturer balancing the need for insuring product containment until usage versus ease of accessibility into the container by the consumer. Thus, the depth of scoring or weakening the scored section in the top of the container is limited to ensure product safety. This limitation which determines the ease of container access has resulted in the inability of many consumers to gain the easy, non-mechanically aided access. As a result, the use of a variety of tools, none of which specifically designed for the task, has been required.

The twist-off cap has presented similar difficulties to many consumers. Although designed for accesssibility without mechanical aid, the primary need for product safety often prevents containers equiped with these caps to be easily removed without aid. And, generally, the same consumer hampered by difficult accessibility to the non-detachable, component can opening system is affected by the short comings of the twist-off container caps.

It is, therefore, the object of this invention to provide an opening device for these opening systems so that consumers desiring to avoid bodily injury or those wishing to gain a mechanical advantage can without difficulty gain access to containers equiped with such opening systems.

It is a further object of this invention to provide an opening device for use on containers having the non-detachable component opening system and those having the twist-off cap, and to provide this device to consumers irrespective of their physical power or physical short comings.

The device of this invention aids in the opening of containers having the non-detachable, component type opening system which is characterized as having a scored section in the container top and an empaling tab in fulcrum alignment with that scored section. The device includes a unitary body member having a leading end portion for sliding beneath the empaling tab, tab restraining means for engaging the top of the empaling tab when the leading end portion is so placed, and a trailing handle portion for grasping by the user of the device. The tab restraining means projects upward from the side edges of the device near the leading end portion, and then projects or bends inwardly spacially parallel the upper surface of the body member. Once placed relative to the empaling tab of the opening system the handle portion of the device is grasped and lifted upward and forward to push the empaling tab into the scored section of the container top. Continued force tears the scored section from the remaining container top and provides access to the contents of the container. At the trailing handle portion of the body member a generally circular aperture is provided to aid in the removal of twist-off caps. The interior periphery of the aperture has inwardly projecting members or is supplied with a beveled resilient insert to securedly engage the grooved outward periphery of the twist-off cap to be removed.

These and other benefits of this invention will become clear from the following description by reference to the drawings, wherein.

Figure 1:
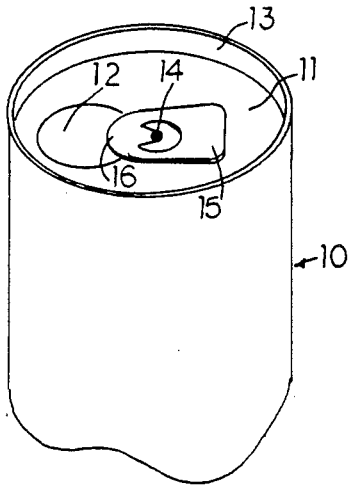
FIG. 1 is a schematic perspective view of a container having a typical non-detachable, component opening system.

Referring to FIG. 1, a container 10, a typical beverage can, is illustrated having a non-detachable, component opening system. Container 10 can be a beverage can as illustrated, or can be any other type of rigid or non-rigid container having a top 11. A scored or weakened section 12 in top 11 and an empaling tab 15 held in fulcrum alignment with scored section 12 by a rivet 14 or other fastening means make up the components of the system. In use, the user grasps the rear portion of tab 15 and by lifting it forces the front portion 16 into the upper surface of the scored portion 12 of the container top 11. The components are generally rigid, such as metal or aluminum alloys. The scored or weakened section 12 also generally has a portion which is congruous, or not scored, with the container top 11 so that it remains attached to the top 11 after empaling tab 15 has been utilized, 13 represents the usual rim around the periphery of a can top 11.

The non-detachable, component type opening system shown in FIG. 1 has shown and continues to show increased use and acceptance in the container industry. It has, particularly, replaced the use of the pull and tear-away ring type opening system. This detachable and throw away system presents obvious difficulties. An increasing number of States have passed legislation requiring that containers sold within their respective jurisdictions have opening systems of the non-detachable type. These laws have been promulgated in response to ecological problems caused by the removable ring type tabs. The pilferage of these tabs has not only caused litter, but has also caused severe physical injury to both domestic and wild animals which have ingested them.

Figure 2:
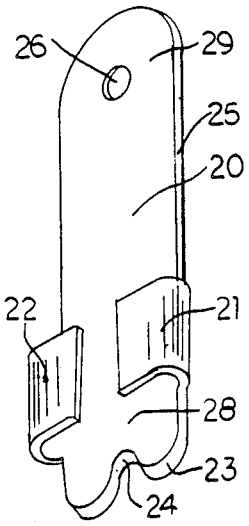
FIG. 2 is a schematic perspective view of one embodiment of the opening device of this invention.

FIG. 2 illustrates an opening device particularly designed to aid in the opening of the non-detachable, component type opening system shown in FIG. 1. The device is comprised generally of a body member 20 having a leading end portion 28 and a trailing end or handle portion 29. The device has tab restraining means indicated by members 21 and 22. Member 21 is shown as contiguously and congruently protruding from side edge 25 at a location removed from frontal edge 23. Member 21 protrudes upward from side edge 25 a distance equal to or larger than the thickness of the empaling tab to be removed, and then protrudes inward and spacially parallel to the upper surface of body member 20. Member 22 forms, in essence, a mirror image of member 21 in that it protrudes from the opposing side edge of body member 20. As shown, the tab restraining means in FIG. 2 as members 21 and 22, are generally located towards the leading end portion 28 of the opening device.

The preferred embodiment of the opening device as shown in FIG. 2 also has a beveled edge 23, sloping downward from the upper surface to the lower surface of body member 20, for reducing the sliding motion force necessary to place the leading end portion 28 beneath the empaling tab 15 to be removed. This embodiment is also shown to have an indented portion 24, generally centered in frontal section 28, to anticipate the rivet 14 configuration of the opening system shown in FIG. 1. The embodiment also shows an aperture 26 located in the handle portion 29 to receive carrying or connecting means such as a key chain for transport of the device.

Figure 9:
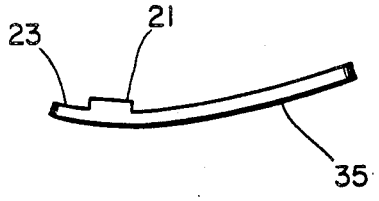
FIG. 9 is a schematic lateral view of another embodiment of the opening device and which shows the device body having a longitudinally curved configuration.

The device shown in FIG. 2 is generally flat in terms of cross section or the curvature of the upper and lower surfaces of body member 20. However, a curved device as shown in FIG. 9 having a body 35 with a generally concave configuration relative to the top surface is part of this disclosure. This configuration aids the engagement of the device to the empaling tab 15 because the tab generally lies downward from rim 13 on a container top 11. The upper surface of this embodiment is also equiped to receive printing or etching to identify the manufacturer or source or advertiser of the device. The benefits of these and other features will become clear as the opening device of this invention is descibed in use.

Figure 3:
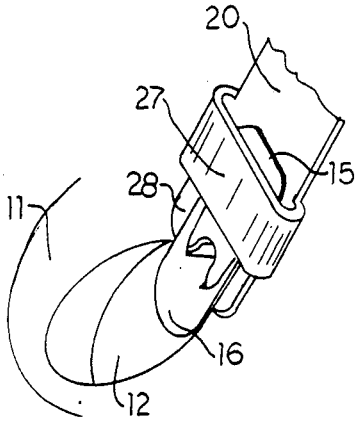
FIG. 3 is a schematic perspective view illustrating another embodiment of the invention in use on an opening system of a container.

FIG. 3 illustrates another embodiment of the opening device and it is shown in operation. The tab restraining means is here illustrated as a continuous member 27 which is contiguously and spacially parallel to body member 20. In essence, members 21 and 22 have been joined together. From a manufacturing standpoint, the embodiment of FIG. 2 would generally be preferable in that members 21 and 22 could initially be cut or stamped from flat metal stock, for example, and then bent over in the spacially parallel configuration as shown.

In FIG. 3, the handle portion 29 of the opening device is grasped by the user, and the forward extending beveled front portion 28 is slid beneath empaling tab 15 of the opening system located on top of a container 10. As the device is so moved, it ultimately abuts near rivet or fastener 14. At this point in the process, tab restraining means, i.e., folded ear members 21 and 22, continuous spacially parallel member 27, or cavity 20 FIG. 4 will have covered at least partially the top of empaling tab 15. The user then lifts the handle portion 29 of the device upward and forward, and thereby causes the front portion 16 of tab 15 to engage the at least partially scored or weakened section 12 of the container top 11. Continued force by the user results in the tearing away of section 12 along its score line, and, thereby, allows the user to gain access to the contents of the container. After bending or otherwise placing section 12 in a downward position, the user can easily slide or otherwise remove the opening device from tab 15 after placing the tab in a desired position, i.e., parallel to top 11 or generally in its original position.

The opening device of this invention allows a user to open a container of the non-detachable, component type in a fashion that requires less force, while subjecting the user to a reduced chance of injury. The device also allows users with particular physical shortcomings or attributes to gain a mechanical, leveraged advantage in the opening process of containers having this type of system. For example, consumers having long finger nails, large fingers, stubby fingers, or missing finger members, or simply decreased function or strength may have considerable difficulty or may find it even impossible to open these component type systems. These consumers and all others as well will be aided by the grasping and mechanical advantages of this invention.

The composition and size of the body member 20 and restraining means of the device is dependent upon the size and location of the empaling tab 15 to be engaged. For example, the depth of the container rim 13 may require that body member 20 be curved particularly at its leading end portion 28. A concave curved configuration relative to the upper surface of body member 20 would facilitate this situation. Likewise, the distance between tab engaging ear members 21 and 22 at their respective bases, or the width of body member 20, is at least the width of the widest point of the empaling tab 15. And, the spacially parallel distance of of these ear members, or restraining means, from the upper surface of body member 20 is at least the thickness of the empaling tab 15 to be engaged.

One embodiment of this device having a thickness of approximately 1/16 inch, $2\frac{1}{2}$ inch length, $\frac{7}{8}$ inch width, and having tab restraining ear members of $\frac{3}{8}$ inch length projecting from body 20 side edges, 7/16 inch width, and located approximately 5/16 inches from the leading end portion and 3/32 inches spacially parallel from the upper body surface, to be well suited for several types of opening systems. This embodiment was made of metal stock, but devices of plastic or other rigid compositions would likewise be usable.

Figure 4:
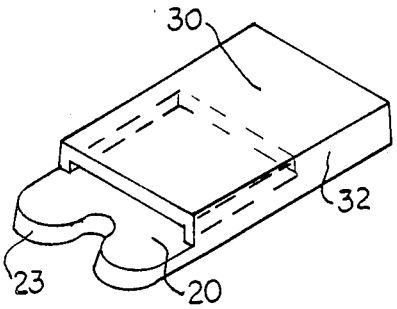
FIG. 4 is a schematic perspective view of another embodiment of the opening device of this invention.

One embodiment particularly suited for injection molding is shown in FIG. 4. Generally, top member 30 is an extension toward the rear handle portion of the device as shown in FIG. 3. An aperture above the upper surface of body member 20 is provided in this embodiment in that side edge 32 extends rearward from generally the leading edge 23 through the handle portion of the device. In other words, the handle portion becomes greater in thickness in this embodiment, and the top surface of this embodiment is congruously merged with the restraining means of the device. The aperture may protrude through to the handle portion of the device without reducing the benefit of the embodiment.

Although the embodiments of this invention thus far described have generally disclosed the tab restraining means projecting from the opposing side edges of the body member, and near the frontal edge, these means could project from any part of either the upper or lower surface of body member 20 as long as those means can restrain the empaling tab of an opening device during the opening process. Thus, the restraining means shown in these embodiments could be utilized to slide between the container top 11 and the bottom of the empaling tab as long as the restraining means are properly located at the side edges of the body member of the device. The invention would then be utilized in an upside down fashion.

Figure 5:
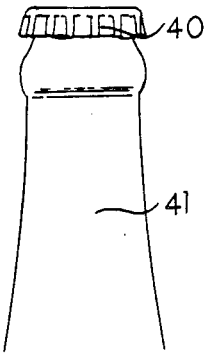
FIG. 5 is a schematic side view of a bottle having a twist-off cap.
Figure 6:
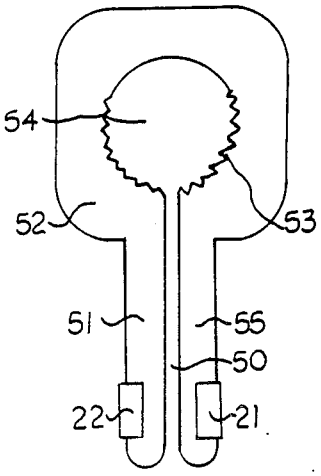
FIG. 6 is a schematic top view of another embodiment of the invention having a contractible circular aperture at its handle portion for removing twist-off container caps.
Figure 7:
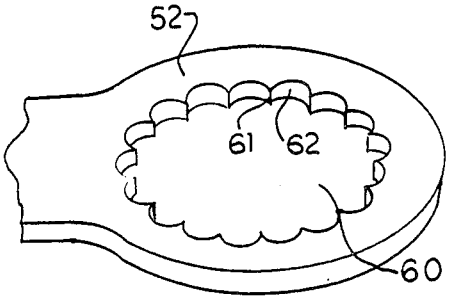
FIG. 7 is a schematic perspective view of another embodiment of the handle portion of the invention for removing twist-off container caps.
Figure 8:
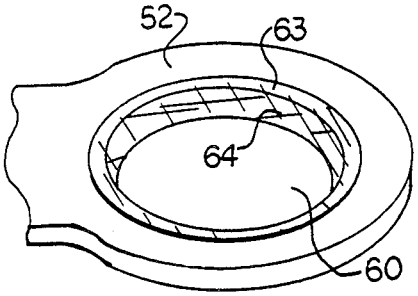
FIG. 8 is a schematic perspective view of another embodiment of the handle portion of the opening device of the invention for removing twist-off container caps.

The embodiments shown in FIGS. 6, 7 and 8 show generally circular apertured features 54 and 60 at generally the trailing handle portion of the device. These circular apertures allow the invention to aid in the opening of twist-off container caps. A typical twist-off bottle cap 40 is shown in FIG. 5. Cap 40 is shown secured to the neck 41 of a bottle. The removal of these twist-off caps, as the opening of the non-detachable, component opening system described above, can present great burden and difficulty to many consumers. And, generally, the same consumer that has difficulty negotiating the opening process of the latter will have difficulty removing the twist-off container cap. The embodiments shown in FIGS. 6, 7, and 8 will allow this consumer to be aided in gaining access to containers having either of these closures.

FIG. 6 illustrates an embodiment having a generally circular aperture 54 within a widened handle portion 52. Aperture 54 additionally has grooved and projecting members 53 which project inward from the periphery of the aperture. Members 53 provide an irregular gripping surface for the aperture. In addition, a longitudinally extending aperture 50 projects from aperture 54, through the body member of the device parallel to its opposing outside edges, between restraining members 21 and 22, and to the leading edge of the device. In use, aperture 54, having a diameter generally slightly larger than that of the twist-off cap to be removed, is placed in an engaging circumferential position about it. After so placed, body portions 51 and 55 are squeezed in a lateral direction to grip the cap. The device is then laterally rotated to remove the cap 40 from the container or bottle.

FIG. 7 illustrates a handle portion 52 having an aperture 60 having an interior surface periphery of projections 61 and indentations or grooves 62. The projections and indentations 62 are designed to match in an out of phase relationship the exterior side periphery of the twist-off container cap. This allows the aperture to securedly engage the cap for rotational purposes. The projections 61 can either be projected outward in a perpendicular configuration relative to the surface of handle portion 52, or can be conically arranged in order to provide a more snug fit with the typically conical side surface of the twist-off cap.

FIG. 8 shows aperture 60 in handle portion 52 of the device. In this embodiment, the aperture is provided with a compressible and resilient insert member 63. The insert forms the inner surface of the aperture and is held in place by either a fastening means such as a glue or by opposing circumferential ridges, having an outside diameter larger than aperture 60, which respectively rest on the opposing outside surfaces of the handle portion. To aid in the secure engagement of the interior surface 64 of the insert to the outside periphery of the twist-off cap, the insert 63 has a beveled or conically projecting configuration. In use, handle portion 52 is placed with interior surface 64 of insert 63 in engagement with the exterior side periphery of the cap. Pressure is applied to the top surface of the handle portion so that the compressible insert member 63 made of rubber or plastic firmly grips the cap and allows the user of the device to rotationally remove the twist-off cap.

Although the embodiments of FIGS. 6, 7 and 8 respectively illustrate the generally circular aperture to be located in the handle portion of a device, these apertures could be located at any place in the device as long as it does not interfere with the functionality of the opening mechanism for the opening of non-detachable, component opening systems. And, these features could obviously be utilized without the necessity that this latter feature be a component of the opening device.

As many changes are possible to the embodiments of this invention utilizing the teachings of the invention, the descriptions above and the accompanying drawings should be interpreted in the illustrative sense and not in the limited sense.

That which is claimed is:

1. A device for opening a non-detachable, component opening system of a container of the type having a scored section at its top and an empaling tab having a fastener for fastening the empaling tab in a fulcrum alignment to the scored section, said device comprising:

(a) a unitary body member having an upper surface, a lower surface, a thin leading end portion, a trailing handle portion, and oppositely facing side edges, said thin leading end portion being for sliding beneath the empaling tab of the opening system, and said trailing handle portion for grasping by a user of said device, said thin leading end portion further having a centrally disposed indented portion for receiving and abutting the empaling tab fastener, and (b) a rigid tab restraining means for securely engaging at least a portion of the top surface of an empaling tab during the opening of a container having a non-detachable, component opening system, said restraining means projecting generally upward from said body member upper surface at generally said oppositely facing side edges and further projecting spacially parallel to at least a portion of the upper surface of said body member, whereby, the placement of said device with said leading end portion placed beneath an empaling tab, with said centrally disposed indented portion of said leading end portion abutting against the empaling tab fastener, and with said tab restraining means positioned above an empaling tab allows a user of said device to grasp and lift said trailing handle portion and, to thereby, easily separate and push downward the scored section of an opening system to gain access to a container.

2. The device of claim 1 wherein said thin leading end portion is beveled downward from said upper surface to said lower surface of said body member, said beveled leading end portion to aid the sliding of said leading end portion beneath the empaling tab of the opening system.

3. The device of claim 1, wherein said unitary body member has a longitudinally curved cross section said longitudinally curved cross sectional body configuration being disposed at least at said leading end portion so that said leading end portion is more easily slid beneath the empaling tab of the opening system.

4. The device of claim 1 wherein said tab restraining means is a unitary structure congruent with said body member and projecting upwardly from its upper surface at generally said opposing side edges of said body member, said unitary restaining means further projecting spacially parallel to at least a lateral segment of said upper surface of said body member.

5. The device of claim 1 wherein a generally circular aperture extends through said body member for aiding the removal of twist-off container caps having a grooved outer periphery said circular aperture being located in said body member between said leading end portion and said trailing handle portion, said generally circular aperture further having inwardly projecting member about its interior surface for engagingly matching the grooved portions of a cap to be removed, said inwardly projecting members extending from said upper surface to said lower surface of said body member, whereby the placement of aid generally circular aperture securedly about an outer periphery of a cap allows a user to gain a rotationally, leveraged advantage to remove a twist-off cap.

6. The device of claim 4, wherein said tab restraining means projects spacially parallel generally the entire upper surface of said body member and wherein said upwardly projecting portions of said restraining means congruently merge with said oppositely facing side edges of said body member.

7. The device of claim 1, wherein said unitary body member has a generally small aperture located in said trailing handle portion, said small aperture for providing means to carry said device, said device further having an upper surface capable of receiving printed matter whereby source identifiable printing can be placed thereon.

8. The device of claim 1, wherein a generally circular aperture for aiding the removal of twist-off container caps having a grooved outer periphery is located between said leading end portion and said trailing handle portion, said generally circular aperture further having a beveled resilient insert securedly placed about its interior periphery, whereby the placement of said beveled resilient insert about the outer periphery of the cap gives the user of said device a leveraged, mechanical advantage in the twist-off removal of the cap.

9. The device of claim 5, wherein said body member of said device has a longitudinally extending aperture generally parallel the opposite side edges of said body member, said longitudinal aperture extending from said generally circular aperture to said leading end portion, whereby said body member can be laterally displaced by squeezing. to tighten said generally circular aperture about the grooved periphery of the cap to be removed.

10. A device for engaging a generally flat empaling tab of a non-detachable component opening system of a container having an empaling tab riveted to its top in a pivotal relationship to a partially scored section of an opening system, said device comprising an elongated, unitary body member having a first surface and a second surface, a leading end portion and a trailing end portion, said leading end portion further being generally thin and flat in configuration and having a centrally located, generally concave indentation therein for receiving and abutting the rivet of the empaling tab of the container opening system, said body member further having a rigid, tab restraining means projecting upwardly from said first surface inward its leading end portion, said restraining means further having portions being spacially parallel said first surface, whereby, the placement of said device with an empaling tab of an opening system situated between said first surface and said spacially parallel portion of said tab restraining means, and with said leading end portion concave indentation abutting the empaling tab rivet, allows a user of said device to lift said trailing end portion, and to thereby, gain a mechanical advantage, by the pivotal movement of said device body about its leading end portion indentation, in pushing an empaling tab into a scored section of an opening system to gain access to a container.

11. A device to aid in the opening of a non-detachable, component opening system of a container of the type having a scored section at its top and an empaling tab having a fastener and being in fulcrum alignment to that scored section, said device comprising an elongated, generally thin and flat, unitary body member having an upper surface, a lower surface, a leading end portion and a trailing end portion, said leading end portion further having a centrally disposed indentation, said body member further having opposing tab restraining ear members congruously extending in a traverse configuration near the leading end portion of said elongated body member, said ear member being bent to have their outer ends spatially parallel to one surface of said body member, whereby, the placement of said device with said leading end portion beneath an empaling tab and the indentation abutting the tab fastener, and with said tab restraining ears above the empaling tab, permits a user to easily push the empaling tab into the opening system's scored section by lifting the trailing end portion of the device, and to, thereby, gain a leveraged mechanical advantage by pivoting said device about its secured, abutted and indented leading end portion.

* * * * *